US011221019B2

(12) United States Patent
Will

(10) Patent No.: US 11,221,019 B2
(45) Date of Patent: Jan. 11, 2022

(54) CENTRIFUGAL PUMP HAVING A RADIAL IMPELLER

(71) Applicant: KSB SE & Co. KGaA, Frankenthal (DE)

(72) Inventor: Bjoern Will, Frankenthal (DE)

(73) Assignee: KSB SE & Co. KGaA, Frankenthal (DE)

( * ) Notice: Subject to any disclaimer, the term of this patent is extended or adjusted under 35 U.S.C. 154(b) by 0 days.

(21) Appl. No.: 16/469,243

(22) PCT Filed: Dec. 5, 2017

(86) PCT No.: PCT/EP2017/081448
§ 371 (c)(1),
(2) Date: Jun. 13, 2019

(87) PCT Pub. No.: WO2018/108617
PCT Pub. Date: Jun. 21, 2018

(65) Prior Publication Data

US 2019/0390686 A1 Dec. 26, 2019

(30) Foreign Application Priority Data

Dec. 14, 2016 (DE) ..... 10 2016 225 018.3

(51) Int. Cl.
*F04D 29/42* (2006.01)
*F04D 29/16* (2006.01)

(52) U.S. Cl.
CPC ..... *F04D 29/426* (2013.01); *F04D 29/167* (2013.01)

(58) Field of Classification Search
CPC ..... F04D 29/426; F04D 29/167; F04D 29/10; F04D 29/12; F04D 29/041; F04D 29/0461; F04D 29/0516
See application file for complete search history.

(56) References Cited

U.S. PATENT DOCUMENTS 1,102,604 A 7/1914 Paulsmeier
3,510,230 A * 5/1970 Raub ..... F04D 29/167 415/174.2

(Continued)

FOREIGN PATENT DOCUMENTS

DE 1 940 555 A 2/1971
DE 2 349 815 5/1974

(Continued)

OTHER PUBLICATIONS

International Preliminary Report on Patentability (PCT/IB/338 & PCT/IB/373) issued in PCT Application No. PCT/EP2017/081448 dated Jun. 27, 2019, including English translation of document C2 (German-language Written Opinion (PCT/ISA/237) previously filed on Jun. 13, 2019) (nine pages).

(Continued)

*Primary Examiner* — Justin D Seabe
*Assistant Examiner* — Ryan C Clark
(74) *Attorney, Agent, or Firm* — Crowell & Moring LLP

(57) ABSTRACT

A centrifugal pump includes a radial impeller surrounded by a housing. The housing has a channel associated with a front side space between a cover of the impeller and the casing. Flow is led through the channel from a pressure region of the pump to a radial gap at a suction region of the pump. The flow in the channel reduces angular momentum and results in an increase in pressure in the front side space which acts of in the cover side of the impeller to offset axial force from a rear side of the impeller.

17 Claims, 4 Drawing Sheets

(56) References Cited

U.S. PATENT DOCUMENTS

| | | | | |
|---|---|---|---|---|
| 4,023,918 | A | 5/1977 | Stahl | |
| 6,129,507 | A * | 10/2000 | Ganelin | F01D 3/00 415/1 |
| 7,731,476 | B2 * | 6/2010 | Ganelin | F04D 29/0416 415/104 |
| 7,775,763 | B1 * | 8/2010 | Johnson | F04D 29/162 415/111 |
| 2008/0181762 | A1 | 7/2008 | Ganelin et al. | |

FOREIGN PATENT DOCUMENTS

| | | | |
|---|---|---|---|
| DE | 31 04 747 | A1 | 9/1982 |
| DE | 33 30 364 | A1 | 3/1985 |
| JP | 48-642 | B1 | 1/1973 |
| JP | 51-137102 | A | 11/1976 |
| JP | 62-148798 | U | 9/1987 |
| JP | 1-237394 | A | 9/1989 |
| SU | 1275120 | A1 | 12/1986 |
| WO | WO 00/10334 | A2 | 2/2000 |
| WO | WO 00/66894 | A1 | 11/2000 |

OTHER PUBLICATIONS

International Search Report (PCT/ISA/210) issued in PCT Application No. PCT/EP2017/081448 dated Mar. 13, 2018 with English translation (six (6) pages).

German-language Written Opinion (PCT/ISA/237) issued in PCT Application No. PCT/EP2017/081448 dated Mar. 13, 2018 (six (6) pages).

German-language Search Report issued in counterpart German Application No. 102016225018.3 dated Sep. 21, 2017 with partial English translation (11 pages).

Hindi-language Office Action issued in Indian Application No. 201937023022 dated Feb. 15, 2021 with English translation (five (5) pages).

English translation of Japanese-language Office Action issued in Japanese Application No. 2019-531827 dated Aug. 6, 2021 (four (4) pages).

* cited by examiner

CENTRIFUGAL PUMP HAVING A RADIAL IMPELLER

CROSS REFERENCE TO RELATED APPLICATIONS

This application is a continuation of PCT International Application No. PCT/EP2017/081448, filed Dec. 5, 2017, which claims priority under 35 U.S.C. § 119 from German Patent Application No. 10 2016 225 018.3, filed Dec. 14, 2016, the entire disclosures of which are herein expressly incorporated by reference.

BACKGROUND AND SUMMARY OF THE INVENTION

The invention relates to a centrifugal pump having a radial impeller which is surrounded by a casing.

Owing to their design, in radial centrifugal pumps, a resultant axial force on the rotor occurs, which has to be compensated. Here, main components of said axial force are the pressure forces acting on the cover shroud and the rear shroud, which pressure forces are directed oppositely to one another. Generally, the force acting on the rear shroud is significantly greater than the component acting on the cover shroud, with the result that an axial thrust directed on the suction side occurs, which has to be compensated accordingly. In a very general sense, the axial thrust is to be understood as meaning the resultant of all axial forces acting on the rotor.

In WO 00/66894 A1, a method and an apparatus for reducing or eliminating the axial force of a centrifugal pump are described. In one variant, a flow subdivision is achieved in that a set of braking vanes is arranged along the periphery of a cavity. In this way, the rotational speed of the fluid is reduced. Furthermore, a stationary plate is provided along the inner wall of the casing in order to direct a radial flow of the fluid in the direction of the center of the pump.

DE 31 04 4747 A1 describes a centrifugal pump having a regulating collar which is arranged at the impeller on the pressure side or suction side. In one variant of the invention, plates are arranged on the pressure-side impeller side or on the suction-side impeller side of the impeller. The plates are mounted on the shaft of the centrifugal pump or on the impeller neck, in each case so as to be rotatable and axially displaceable.

DE 33 30 364 C2 describes a centrifugal pump having a device for reducing the friction loss of the impeller. The device comprises rotatably mounted plates which are arranged on both sides of the impeller.

Such conventional plate constructions for reducing the axial thrust are susceptible to faults and are often complex in terms of their construction.

It is an object of the invention to specify a centrifugal pump in which the axial thrust on the rotor is reduced in a simple and reliable way. The intention is that the centrifugal pump is distinguished by a high service life and operation which is as fault-free as possible. It is furthermore the intention that the centrifugal pump is relatively inexpensive to produce and has the highest possible efficiency.

According to the invention, the casing of the centrifugal pump has a channel for guiding a flow from an impeller side space of the pump to a radial gap of the pump. Here, said flow is preferably a swirling leakage flow from the impeller.

By way of said construction, the angular momentum flow entering the front impeller side space from the impeller is diverted and fed directly to a radial gap via an additional channel running through the casing.

The flow is preferably guided past the front impeller side space from the impeller and then enters the channel.

A radial sealing gap which is formed between a cover shroud of the impeller and a casing part is preferably involved here. The channel arranged in the casing has only stationary walls. These act as "swirl brakes" and reduce the circumferential speed component at which the volume flow guided through the channel enters the gap. Here, it has proven to be expedient that, as a consequence, the damping in the radial sealing gap is moreover increased.

The sealing gaps in centrifugal pumps additionally act as radial bearings, and the forces in the gap seals have a large influence on the vibration behavior of the rotor. The damping of this vibratory system is determined by the ratio of axial speed to circumferential speed of the flow at the entry to the sealing gap. Lower circumferential speeds mean increased damping.

Owing to the diversion of the angular momentum flow, the rotation of the fluid in the actual impeller side space is greatly reduced, whereby the axial force acting on the rotor in this region of the impeller side space is increased.

The impeller preferably has both a rear shroud and a cover shroud. Consequently, it is a closed impeller.

In one particularly expedient variant of the invention, the channel is arranged in the casing such that the flow enters the channel from a front impeller side space. Here, "front impeller side space" is to be understood as meaning the space between the rotating cover shroud and the stationary casing. Generally, the force acting on the rear shroud in centrifugal pumps is significantly greater than the component acting on the cover shroud. By way of the construction according to the invention of an arrangement of a channel in the casing, which channel has a connection to the front impeller side space, the axial thrust directed on the suction side is effectively compensated.

The channel leads from the impeller side space to a radial gap and preferably has a ring-shaped cross section. The entry opening into the channel is likewise preferably formed so as to be ring-shaped along the circumference in the impeller side space.

The volume flow flowing through the ring-shaped channel is preferably fed to a radial sealing gap which is formed between the cover shroud of the impeller and a casing part. Preferably, the centrifugal pump has a split ring seal arrangement with a fixed split ring and with a rotating running ring which is arranged on the cover shroud of the impeller. In one variant of the invention, the channel guides the flow on the impeller side next to the split ring seal arrangement. Preferably, the flow is introduced downstream, so that the flow still flows through the sealing gap. Said sealing gap is thus situated directly after the channel in the context of the throughflow sequence. The flow enters the split ring seal arrangement from the channel.

Consequently, in this variant, as seen from the suction side, firstly the split ring seal arrangement with a split ring and with a running ring between the cover shroud and the casing part is provided, and subsequently the volume flow discharged through the channel enters the radial sealing gap, which is formed between the cover shroud and a casing part. This is very advantageous in terms of rotor dynamics since, in this way, the damping in the sealing gap is increased.

The diversion of the angular momentum flow results in the rotation of the fluid in the front impeller side space being greatly reduced, whereby the axial force acting on the cover shroud is increased. Since the axial force acting on the rear shroud is generally significantly greater, the increase in the force component acting on the cover shroud results in the resultant residual force being greatly reduced or, ideally, compensated. In particular in multi-stage pumps, such as for example boiler feed pumps, the axial thrust compensation plays a very important role. The construction according to the invention leads to reliable operating behavior and to an increase in the efficiency.

In one variant of the invention, the channel has a section which extends in an axial direction. Consequently, the fluid from the impeller side space firstly enters the channel in an axial direction and is preferably then diverted in a radial direction, wherein the channel has a section which extends in a radial direction. Furthermore, the channel may have a section which runs largely parallel to the cover shroud.

The channel is preferably delimited by a casing part having an L-shaped cross-sectional profile. The casing part may be of pot-like or bell-like design and is arranged spaced apart from a further casing part such that a channel with a ring-shaped cross section is formed.

Due to the construction according to the invention, the angular momentum flow entering at the outer edge does not enter the actual impeller side space but the outer channel. The pump effect of the rotating cover shroud generates an additional blocking effect. Since all the walls are stationary in the channel, the circumferential speed is greatly reduced, with the result that a swirl brake is formed. As a result of the diversion of the angular momentum flow, the rotational speed of the fluid in the actual impeller side space is reduced, which results in an increase in the pressure and, correspondingly, the axial pressure force on the cover shroud. In this way, better compensation of the pressure force, acting oppositely, on the rear shroud is achieved. A flow region in which the radial speed decreases according to an S-shaped curve is preferably formed in the impeller side space between the impeller and the casing. Furthermore, it proves to be advantageous if a flow region in which the tangential speed remains largely constant outside the boundary layers on the rotating and stationary parts is formed between the impeller and the casing.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
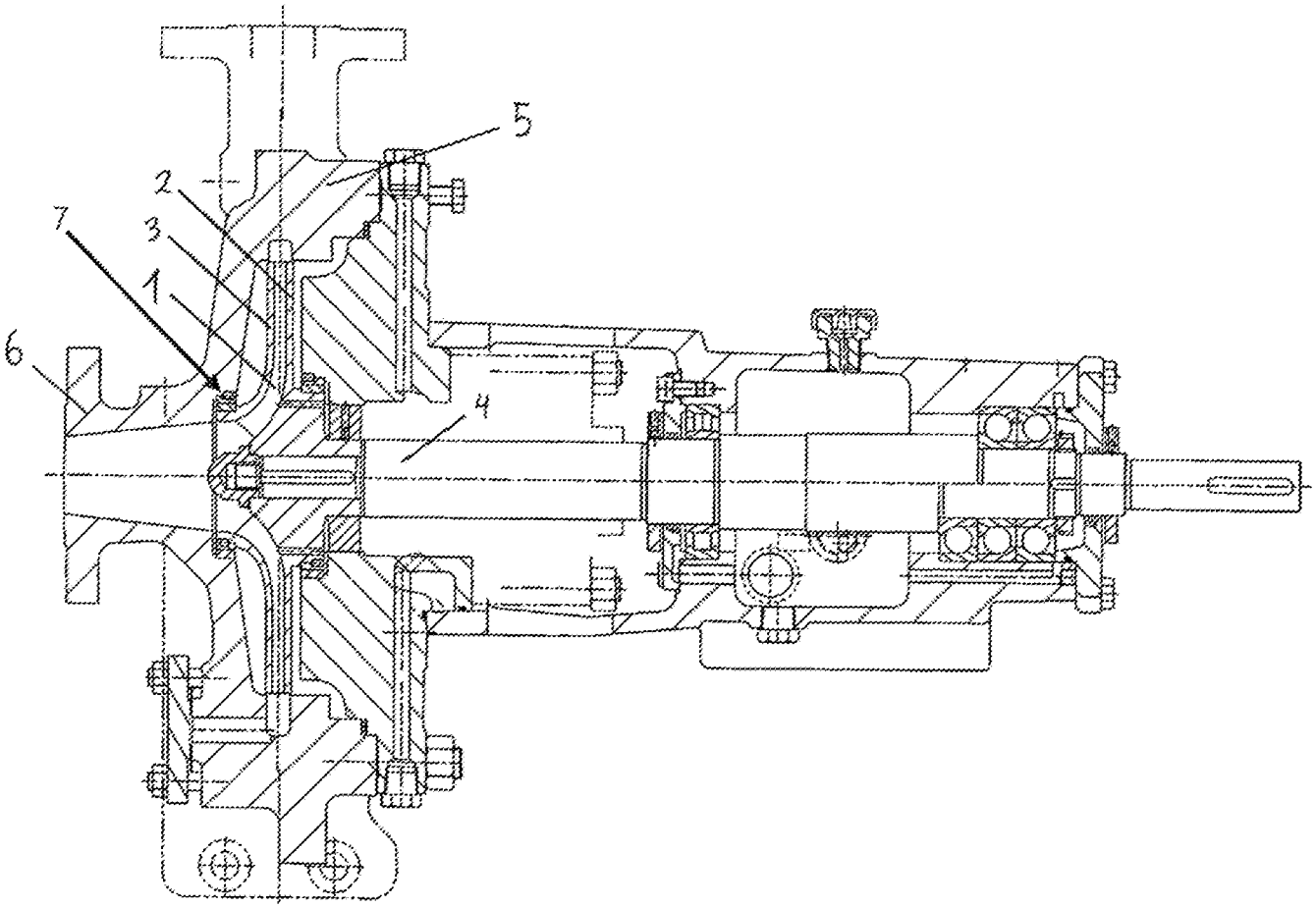
FIG. 1 shows a sectional illustration through a centrifugal pump in accordance with an embodiment of the present invention.

FIG. 1 shows a centrifugal pump with an impeller 1. The impeller 1 is designed in the form of a closed radial impeller and has a rear shroud 2 and cover shroud 3. Vanes are arranged on the rear shroud 2. Passages for delivering the medium are formed between the rear shroud 2 and the cover shroud 3. The impeller 1 is driven by a shaft 4. The impeller 1 is surrounded by a casing 5 which may be of multi-piece design. The casing 5 has a suction mouth 6. The centrifugal pump has a split ring seal arrangement 7. The split ring seal arrangement 7 delimits the gap volume flow which flows from the pressure region of the centrifugal pump back into the suction region. The impeller 1 is designed in the form of a radial impeller. The fluid flows to the impeller 1 in an axial direction and is then diverted through 90° and then exits the impeller 1 in a radial direction.

Figure 2:
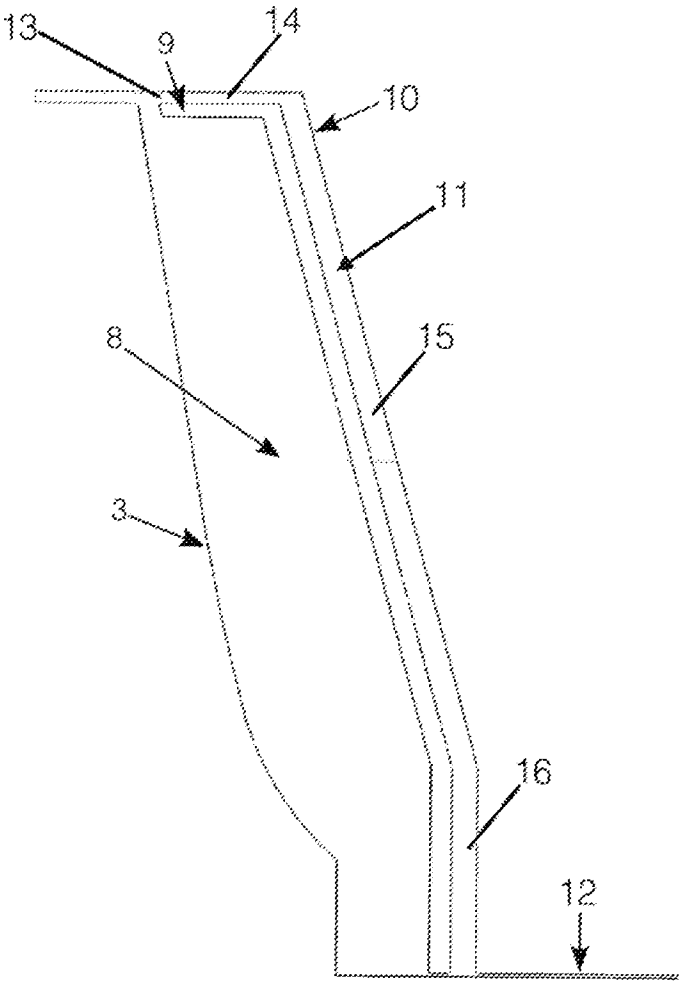
FIG. 2 shows a schematic illustration of a channel of the FIG. 1 embodiment.

FIG. 2 shows a schematic illustration of the front impeller side space 8 which is formed between the cover shroud 3 of the impeller and a casing part 9. The casing part 9 forms, together with a further casing part 10, a channel 11 for guiding a flow from the front impeller side space 8 to a radial gap 12.

The angular momentum flow entering the front impeller side space 8 from the impeller is, at the outer edge, guided not into the actual front impeller side space 8 but into the outer channel 11. The channel 11 is delimited by stationary walls of the casing parts 9, 10. Consequently, the circumferential speed is greatly reduced and the channel 11 acts as a swirl brake. The diversion of the angular momentum flow results in the rotational speed of the fluid in the actual impeller side space 8 being reduced. This leads to an increase in the pressure in the front impeller side space 8 and thereby to an increase in the axial pressure force on the cover shroud 3. A counterforce to the pressure force which acts on the rear shroud 2 is thereby formed. The gap volume flow enters a first section 14 of the channel 11 through a ring-shaped opening 13, which first section extends in an axial direction.

The gap volume flow is then diverted in the channel 11 and enters a second section 15, which runs largely parallel to the cover shroud 3.

Finally, the volume flow flowing through the channel 11 flows into a third section 16, which extends in a radial direction.

The casing part 9 has an L-shaped cross-sectional profile in order to form both a section in an axial direction and a section in a radial direction or parallel to the cover shroud 3. The casing part 9 is of pot-shaped or bell-like design.

Figure 3:
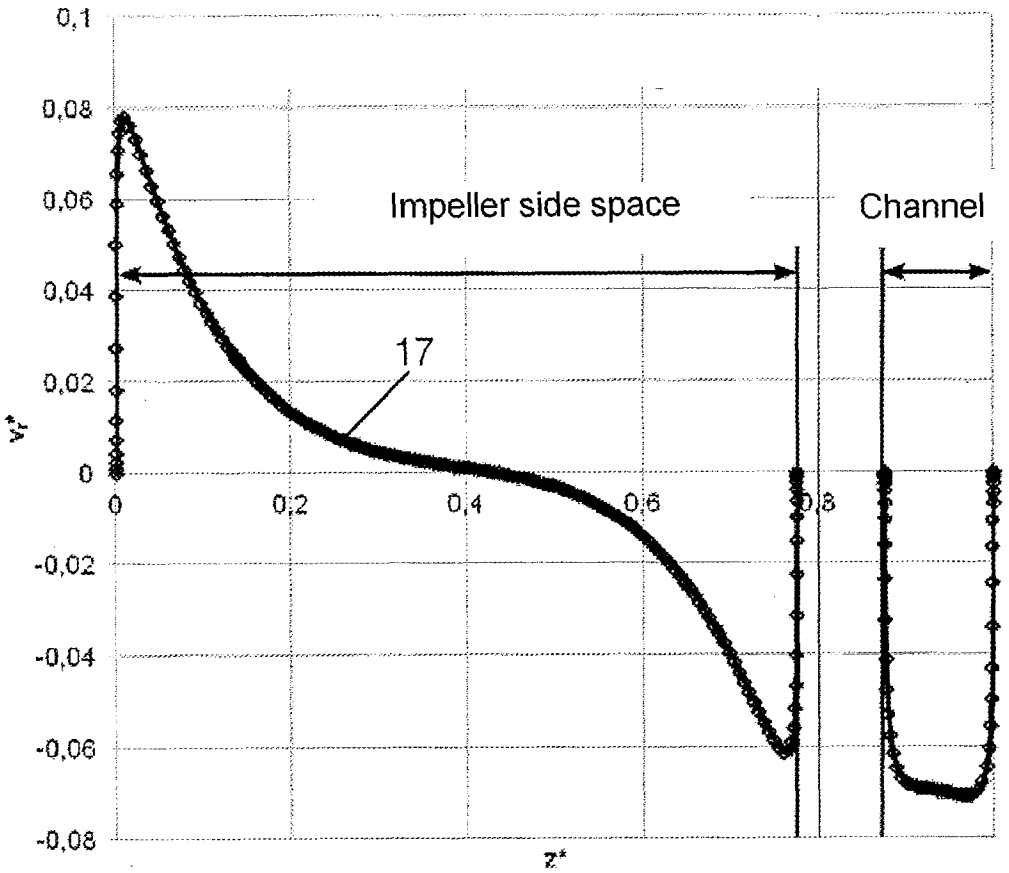
FIG. 3 shows a curve of the radial speed profile of the FIG. 1 embodiment.

FIG. 3 shows the curve of the dimensionless radial speed at a central section. In this context, "central section" means that the speed profile at the mid-height (in a radial direction) between the shaft and the outer (radial) casing is involved. That is to say, exactly at the center of the impeller side space shown. The radial speed is 0 directly on the cover shroud and then increases sharply in the immediate vicinity of the cover shroud to a value of almost 0.08. Subsequently, a flow region 17 is formed in which the radial speed decreases in the manner of an S-shaped curve to a value of approximately −0.06. In the direction of the fixed, stationary casing part 9, the radial speed then increases again until it reaches a value of 0 on the casing part itself.

FIG. 3 shows that a radial flow profile which is almost of piston-like form is formed in the channel, wherein the radial speed is 0 on the fixed walls of the casing parts 9, 10 and then the radial speed increases sharply in an axial direction to a value of approximately −0.07 and then remains almost constant and then decreases again to a value of 0 in the direction of the next casing part 10.

Figure 4:
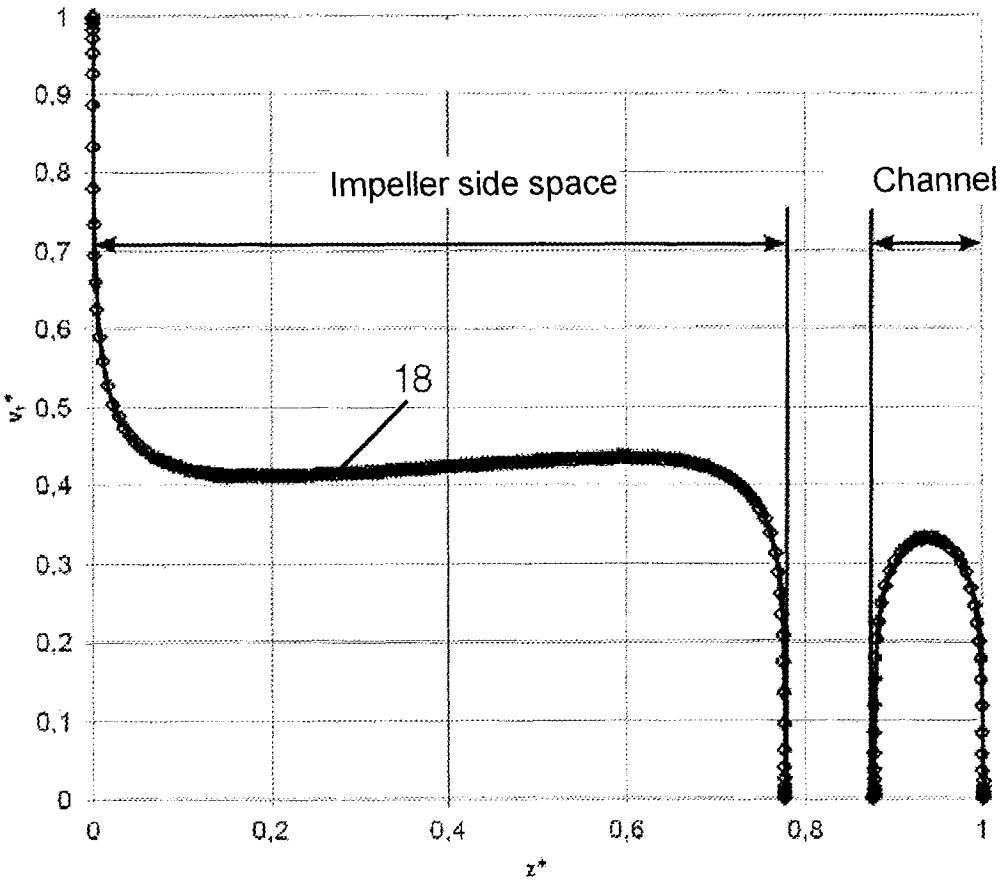
FIG. 4 shows an illustration of the curve of the tangential speed profile of the FIG. 1 embodiment.

FIG. 4 shows the curve of the dimensionless tangential speed. This is 1 at the beginning on the cover shroud of the impeller and then decreases sharply to a value of approximately 0.4. The tangential speed then remains largely constant in a flow region 18 before it decreases to a value of 0 in the direction of the stationary casing part 9. Within the channel 11, a parabolic curve of the tangential speed is formed, wherein, at the fixed ends of the casing parts 9 and 10, the speed increases from a value of 0, reaches a maximum and then decreases again. The flow profile is of approximately symmetrical form.

The magnitude of the tangential speed is decreased as a result of the friction on the stationary walls when the channel is flowed through. A reduction in the swirl occurs. In this context, "reduction in the swirl" is to be understood as meaning a reduction in the tangential speed on the stationary walls as a result of the friction. A flow with a circumferential speed component is referred to as "swirling".

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A centrifugal pump, comprising:

a casing, the casing including an inlet-side wall extending radially between a pump inlet and a pump outlet; and a radial impeller surrounded by the casing, wherein the casing includes a channel configured to guide a flow from a front impeller side space, the channel being formed between the inlet-side wall of the casing and a casing part, the casing part being located between a cover side of the radial impeller and the inlet-side wall of the casing, the front impeller side space is located between the cover side of the impeller and the casing, the casing part includes an axial section aligned parallel to an impeller rotation axis connected to a radially outer end of the casing part, the axial section of the casing part is not in contact with the casing in a region of the casing facing radially inward toward the axial section, and a surface of the region of the casing facing radially inward toward the axial section of the casing part has the same radius from the impeller rotation axis as a region of the casing facing radially inward toward the radially-outer end of the impeller.

2. The centrifugal pump as claimed in claim 1, wherein the flow enters the channel from the front impeller side space through a radial gap between the axial section of the casing part and the region of the casing facing radially inward toward the axial section.

3. The centrifugal pump as claimed in claim 2, wherein the channel has a radial section extending in a radial direction.

4. The centrifugal pump as claimed in claim 3, wherein the impeller has a cover shroud at the cover side.

5. The centrifugal pump as claimed in claim 4, wherein at least a portion of the radial section of the channel is arranged parallel to the cover shroud.

6. The centrifugal pump as claimed in claim 4, wherein the radial gap is a sealing gap.

7. The centrifugal pump as claimed in claim 6, wherein the centrifugal pump has a split ring seal arrangement which includes the sealing gap.

8. The centrifugal pump as claimed in claim 7, wherein the channel guides the flow on the impeller side to a region adjacent to the split ring seal arrangement.

9. The centrifugal pump as claimed in claim 8, wherein the channel is delimited by a casing part having a generally L-shaped cross-sectional profile.

10. The centrifugal pump as claimed in claim 9, wherein the casing part is pot-shaped or bell-shaped.

11. The centrifugal pump as claimed in claim 10, wherein a flow region in the front impeller side space has a radial speed profile with an S-shaped curve.

12. The centrifugal pump as claimed in claim 1, wherein a flow region in the front impeller side space has a radial speed profile with an S-shaped curve.

13. The centrifugal pump as claimed in claim 11, wherein a flow region in the front impeller side space has a tangential speed profile that is largely constant.

14. The centrifugal pump as claimed in claim 12, wherein a flow region in the front impeller side space has a tangential speed profile that is largely constant.

15. The centrifugal pump as claimed in claim 1, wherein a flow region in the front impeller side space has a tangential speed profile that is largely constant.

16. The centrifugal pump as claimed in claim 1, wherein at least a portion of the channel has a ring-shaped cross-section.

17. The centrifugal pump as claimed in claim 8, wherein at least a portion of the channel has a ring-shaped cross-section.

* * * * *